US005908793A

United States Patent [19]

Fleissner

[11] Patent Number: 5,908,793

[45] **Date of Patent: *Jun. 1, 1999**

[54] METHOD FOR MANUFACTURING A SOLIDIFIED FIBER FLEECE, THE RESULTING SOLIDIFIED FIBER FLEECE, AND USE OF THIS FLEECE

[75] Inventor: Gerold Fleissner, Zug, Switzerland

[73] Assignee: Fleissner GmbH & Co. Maschinenfabrik, Egelsbach, Germany

[ * ] Notice: This patent is subject to a terminal disclaimer.

[21] Appl. No.: 09/098,496

[22] Filed: Jun. 17, 1998

Related U.S. Application Data

[62] Division of application No. 08/584,674, Jan. 11, 1996, Pat. No. 5,770,532.

[30] Foreign Application Priority Data

Jan. 12, 1995 [DE] Germany ..... 195 00 669

[51] Int. Cl.[6] ..... D04H 1/46

[52] U.S. Cl. ..... 442/408; 28/104

[58] Field of Search ..... 442/408; 28/104

[56] References Cited

U.S. PATENT DOCUMENTS

| | | | |
|---|---|---|---|
| 3,485,706 | 12/1969 | Evans | 161/72 |
| 3,664,905 | 5/1972 | Schuster | 161/59 |
| 4,024,612 | 5/1977 | Contractor et al. | 28/72.2 |
| 4,731,277 | 3/1988 | Groitzsch et al. | 428/137 |
| 4,966,808 | 10/1990 | Kawaro | 428/224 |

*Primary Examiner*—James J. Bell

*Attorney, Agent, or Firm*—Antonelli, Terry, Stout & Kraus, LLP

[57] ABSTRACT

Fiber fleeces made entirely of pure artificial (polymeric) fibers or mixed with natural fibers have to be solidified after formation by carding, or laying only in the case of filament fleeces. In the fleece according to the invention, which is particularly bulky and thus needs to be solidified, neither lower-melting binding fibers nor chemical binding agents are used. Also, the mechanical needling process which uses needles is eliminated because this reduces the bulk too severely. The desired bulk is retained by producing solidification by a single water needling process (when performed on one side), with the desired water pressure being no higher than 60 bars, preferably 20–30 bars.

22 Claims, No Drawings

METHOD FOR MANUFACTURING A SOLIDIFIED FIBER FLEECE, THE RESULTING SOLIDIFIED FIBER FLEECE, AND USE OF THIS FLEECE

This application is a Divisional application of application Ser. No. 08/584,674, filed Jan. 11, 1996, now U.S. Pat. No. 5,770,532.

FIELD OF THE INVENTION

This invention relates to a method for solidifying a fiber fleece produced in a thickness as large as 10 mm or more and made of artificial staple fibers formed of material such as polyester, polyethylene, or polypropylene fibers, or of spun filaments made from artificial fiber-forming materials such as polyester, polyethylene or polypropylene, without the use of binding fibers, such as bicomponent or special melt fibers, and without the use of binding agents; the pure artificial fibers or filaments may be mixed with natural fibers.

BACKGROUND OF THE INVENTION

Card fiber fleeces are made from an extremely wide variety of fibers. In general, such fleeces have the advantage that the short fibers are randomly distributed in the finished fleece so that the fleece has better stability in all pulling directions. There are also fleeces made of spun filaments which, once the filaments are made, the filaments are immediately laid down to make a fleece, for example, on an endless belt. The loosely laid fibers or filaments in the fleece produced by the carding machine and those of a spun fleece, however, have to be connected with each other to produce a level of strength that is satisfactory in practice. For this purpose, needling of the fleece mechanically with needles is known. With this fundamentally discontinuous and hence slow solidification process the volume of the fleece is considerably decreased however, so that such a mechanically solidified or needled fleece is useless for many applications. In addition, thin fleeces cannot be needled mechanically at all.

The addition of binding agents to the fibers is also known. For example, these agents are sprayed on in liquid form or by foam impregnation. The disadvantage of such fleece is not only the additional and necessarily expensive chemicals, whose production is somewhat detrimental to the environment, but also the poorer recyclability.

The addition to the fleeces of fibers made with lower-melting chemical fibers as well as bicomponent fibers is also known, and these additive fibers an be at least initially melted by the action of heat so that they stick to the adjacent fibers in the fleece. In this process, the expensive binding fibers and the additionally necessary energy for heating the binding fibers to the melting point is disadvantageous.

Needling the fleeces of the aforementioned type using water is also known. Water needling has the basic advantage of being continuous and hence allowing higher production rates. However, the stiff, paper-like products usually arising from water needling are disadvantageous.

SUMMARY OF THE INVENTION

The goal of the invention is to develop a method for manufacturing a solidified, bulked fleece, such as card fiber or a spun fiber fleece, in which no additional binding chemicals or binding fibers are necessary for solidification and yet the necessary strength is achieved even with this (binder-free) bulked fleece.

Taking its departure from the method of the type referred to above, the solution of this problem is to solidify the fleece solely by a single water needling with a water pressure of only 60 bars at most, and preferably, a water pressure of 20–30 bars.

In particular, the invention is directed to a method for solidifying a fiber fleece which is made of artificial staple fibers, such as polyester, polyethylene or polypropylene fibers or of spun filaments made of such artificial fiber-forming materials as polyester, polyethylene and polypropylene and produced in a thickness as much as 10 mm or more without the inclusion of binding fibers such as bicomponent or special melt fibers and without the use of binding agents, and which may be formed of a mixture of such artificial fibers and natural fibers, wherein the fleece is solidified solely by a single water needling step or operation with a water pressure of only 60 bars at most and, preferably with a water pressure of 20–30 bars.

It has been shown that the fleece—as it comes from the card or the spinning beam after being laid down—does lose bulk in water needling at this water pressure, but, surprisingly, only to an insignificant degree. The fibers become felted when struck by the water jets at the low water pressure such that a sufficiently solidified fleece is produced by only one water needling machine, to be used on an industrial scale. It can be advantageous in this regard for water to be blown onto the fleece under pressure to moisten it before the actual water needling. The moisture can then be readily sucked out of the fleece and possibly removed by heat. Because of the large volume, only a small amount of energy is required to produce the dried fleece.

This water-needled, bulked fleece obtained as a product is also another feature of the invention. This also applies to its use according to the invention.

The method for manufacturing a solidified bulked fleece in accordance with this invention is initially applied to one side of the fleece only. The back side (support side) has a different surface structure after the solidification treatment. If both sides are to be identically structured and surface-treated, the other side of the fleece can also be fed through another water-needling machine. This additional step does not affect the basic process of single treatment. In the case of bilateral needling, it will be appreciated that another product would be desired, which product comes within the scope of the present invention.

What is claimed is:

1. A method for solidifying a fiber fleece which is made of artificial staple fibers including polyester, polyethylene, or polypropylene fibers, or of spun filaments of artificial fiber-forming materials including polyester, polyethylene or polypropylene and produced without binding fibers and without binding agents and which may be mixed with natural fibers, characterized in that the fleece is solidified solely by a single water needling operation with a water pressure of only 60 bars at most.

2. A fiber fleece solidified according to the method of claim 1, wherein the fibers have a titer of 1–15 den.

3. A fiber fleece solidified according to the method of claim 1, wherein the fleece is made of staple fibers and the fibers have a staple length of at least 36 mm.

4. A fiber fleece solidified according to the method of claim 1, said fleece having a weight of up to 200 $g/m^2$.

5. A fiber fleece solidified according to the method of claim 1, said fleece having a density of as much as 0.05 $g/cm^3$.

6. A fiber fleece according to claim 5, having a density from 0.01 to 0.03 $g/cm^3$.

7. A fiber fleece solidified according to the method of claim 1, said fleece having a tensile strength of from 5–300 N/5 cm.

8. A fiber fleece according to claim 7, having a tensile strength of from 10–300 N/5 cm.

9. A fiber fleece solidified according to the method of claim 1, having a thickness of at least 10 mm.

10. A method according to claim 1, wherein said water needling operation is performed at a water pressure of 20–30 bars.

11. A method according to claim 1, wherein the fleece is moistened prior to said single water needling operation.

12. A fiber fleece solidified according to the method of claim 1.

13. A fiber fleece solidified according to the method of claim 10.

14. A fiber fleece which is made of artificial staple fibers, including polyester, polyethylene, or polypropylene fibers, or of spun filaments of artificial fiber forming materials including polyester, polyethylene and polypropylene produced without binding fibers and without binding agents or which is made of a mixture of such artificial fibers and natural fibers, said fleece being solidified solely by a single water needling operation with a water pressure of only 60 bars at most.

15. A fiber fleece according to claim 14, wherein the fibers have a titer of 1–15 den.

16. A fiber fleece according to claim 14, wherein the fleece is made of staple fibers, and the fibers have a staple length of at least 36 mm.

17. A fiber fleece according to claim 14, said fleece having a weight of up to 200 $g/m^2$.

18. A fiber fleece according to claim 14, said fleece having a density of up to 0.05 $g/cm^2$.

19. A fiber fleece according to claim 18, wherein said density is from 0.01 to 0.03 $g/cm^3$.

20. A fiber fleece according to claim 14, said fleece having a tensile strength of from 5–300 N/5 cm.

21. A fiber fleece according to claim 20, having a tensile strength of from 10–300 N/5 cm.

22. A fiber fleece according to claim 14, having a thickness of at least 10 mm.

* * * * *